United States Patent [19]

Richter

[11] 4,177,766

[45] Dec. 11, 1979

[54] HEAT RECOVERY SYSTEM FOR FURNACES AND THE LIKE

[76] Inventor: Edward S. Richter, 1591 SW. 65th Ter., Boca Raton, Fla. 33432

[21] Appl. No.: 911,715

[22] Filed: Jun. 2, 1978

[51] Int. Cl.[2] ..... F22B 1/02; F22D 1/00

[52] U.S. Cl. ..... 122/20 B; 122/355; 122/421

[58] Field of Search ..... 122/20 B, 355, 356, 122/412, 421; 126/364

[56] References Cited

U.S. PATENT DOCUMENTS

| | | | |
|---|---|---|---|
| 2,553,691 | 5/1951 | Waltman | 126/364 |
| 3,793,992 | 2/1974 | Marquez | 122/20 |
| 3,987,761 | 10/1976 | Downs et al. | 122/20 |
| 4,037,567 | 7/1977 | Torres | 122/421 |
| 4,122,801 | 10/1978 | Burns | 122/421 |

*Primary Examiner*—Kenneth W. Sprague

*Attorney, Agent, or Firm*—Morse, Altman, Oates & Bello

[57] ABSTRACT

A modular, heat recovery system is provided for use with furnaces, boilers, and the like where otherwise waste exhaust heat is utilized to heat water for home or apartment use. This system includes a plurality of modular pipe loop sections interconnected with one another and mounted in proximity to the stack of the furnace. Each section includes several courses of longitudinally extending U-shaped loops supported on a common perpendicular pipe section at one end and which forms part of a supply line for other sections. Each section is provided with unions and valves by means of which an entire section maybe disconnected for repairs from the other sections without interruption of the operation of the other sections. A drip pan is provided at the lower end of the system to prevent water leaks from dripping onto the furnace.

5 Claims, 4 Drawing Figures

HEAT RECOVERY SYSTEM FOR FURNACES AND THE LIKE

BACKGROUND OF THE INVENTION

1. Field of the Invention

This invention relates generally to heat recovery systems and more particularly is directed towards a new and improved modular heat recovery system for use in heating water from waste heat exhausting from a furnace or the like.

2. Description of the Prior Art

In all fuel burning furnaces, boilers or the like, such as used in homes and apartments, much of the heat released from the combustion of the fuel is exhausted through the stack and wasted. While various means have been devised to recover some of this waste heat, such measures are generally suitable only for large industrial or marine boilers in which economizers and the like are mounted within the uptake of the boiler. Smaller units for the home furnace generally involve the use of a fan directed against the exhaust stack, radiating heat elements attached to the stack or complex stack designs involving internal piping, baffles, and the like. Such measures have been useful only in heating the area in the immediate vicinity of the furnace. Internal stack systems, while operative, tend to be too expensive for home units and are difficult to repair in the event of leakage.

Accordingly, it is an object of the present invention to provide a new and improved heat recovery system for use on small furnaces and boilers of the sort used in homes or apartments. Another object of this invention is to provide a modular heat recovery system mounted about the exhaust stack of a furnace or boiler and adapted to provide primary or secondary heating of water for use in the building.

A further object of this invention is to provide a heat recovery system for a boiler, or the like, adapted to reduce heat loss and smoke from the boiler and at the same time provide auxiliary water heating capability for the building.

SUMMARY OF THE INVENTION

This invention features a heat recovery system for use with a furnace, boiler, or the like, comprising a plurality of modular sections of water pipe inter-connected one with another, with each modular section comprised of a group of longitudinally extending, U-shaped parallel loops mounted to a common perpendicularly extending pipe supporting all of the loops in each section. Cut-off valves and unions are provided between each section to allow a complete section to be disconnected from the other sections without interrupting the operation of the other sections. All of the sections are enclosed within an insulated housing and a drip pan is provided below the system and above the furnace to prevent water from dripping thereon. The drip pan is supported by tubular legs which also function as a drain line with the ends of each leg being slotted to provide a drain opening at the bottom thereof.

DETAILED DESCRIPTION OF THE PREFERRED EMBODIMENT

Figure 1:
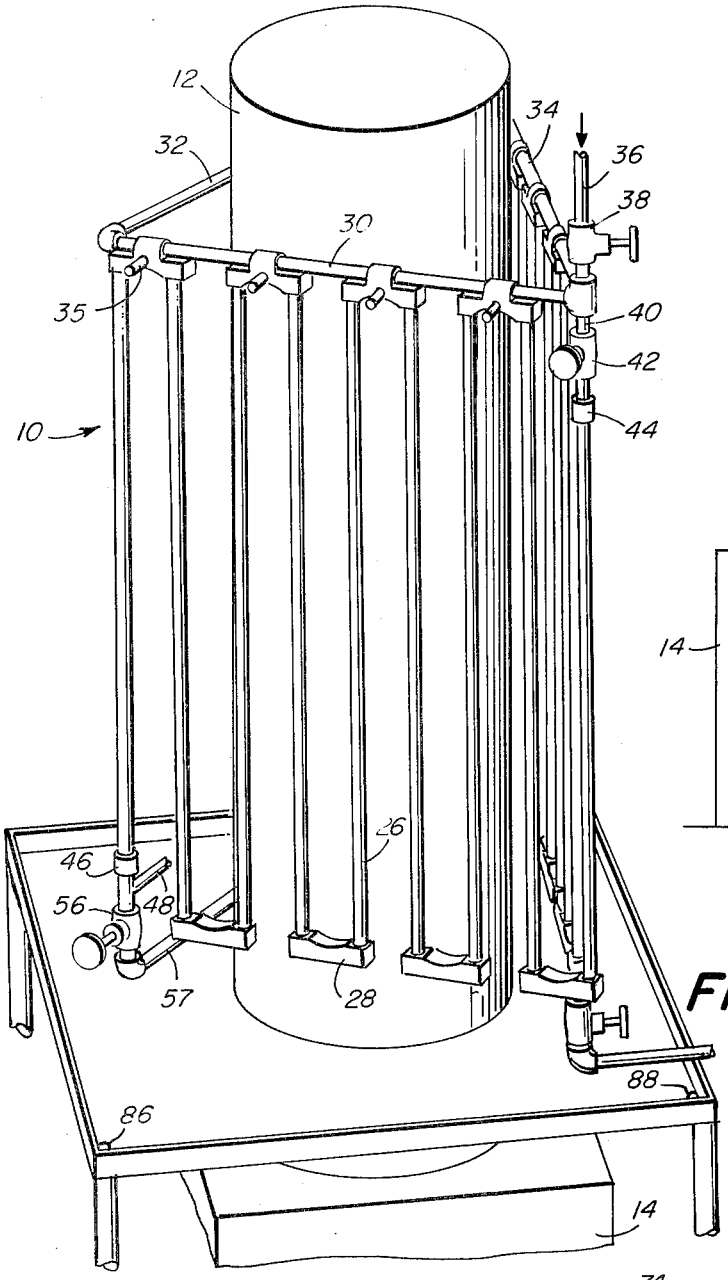
FIG. 1 is a view in perspective of a heat recovery system made according to the invention.
Figure 4:
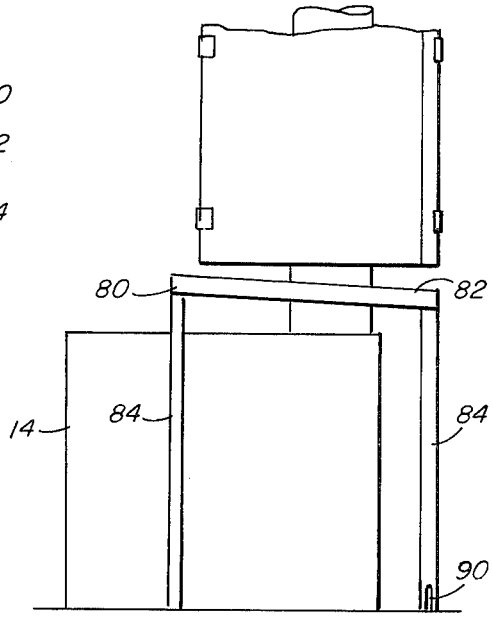
FIG. 4 is a view in side elevation of the invention.

Referring now to the drawings, the reference character 10 generally indicates a heat recovery system for use about the exterior of an exhaust stack 12 for a furnace 14, boiler or the like. The system is particularly useful for furnaces of the sort used in apartment houses although it is readily adapted to smaller units of the sort used in the home or to larger commercial units. In practice, the heat recovery system 10 is enclosed within an insulated housing 18 (FIG. 2) although, for the sake of clarity, the insulated housing is not shown in FIG. 1. The system generally utilizes waste heat passing up through the stack 12 as a primary or secondary source of heat for water. The water may be used in the hot water system of the building, home, apartment etc. or may be used as a pre-heating stage in a forced hot water heating system for the building. In any event, the system is comprised of modular sections 20, 22 and 24 which sections, in normal operation, are inter-connected one with the other although any one or two sections may be isolated from the remaining section(s) in any combination and the system will remain operable. In the illustrated embodiment three such modular sections are shown although this number may be increased or decreased, as desired.

Each modular section is comprised of a number of lengths of pipe 26 defining a plurality of reversing U-shaped loops each pipe length being parallel with the others and in the same plane for each section. In the illustrated embodiment each section includes nine lengths of pipe, typically each pipe being 8 ft. in length, and connected at their ends to return bends 28 typically of 1" malleable iron. The upper return bends are connected by metal straps, U-bolts, or otherwise to one of three horizontal pipes 30, 32 and 34 with an entire section being suspended from each horizontal pipe, as shown. In the illustrated embodiment, the three modular sections 20,22 and 24 are arranged in a triangle about the vertical duct 12 and in generally tangential relation thereto in order to utilize the heat from the duct to heat water flowing through the pipes.

The horizontal pipes 30, 32 and 34 may be mounted to a wall, duct, frame etc. by any suitable means such as a bracket type hanger or the like. The upper return bends 28 of each section are provided with vents 35, typically in the form of pet cock valves which serve to bleed off any entrained air that may be present in the system. Water is introduced to the system by means of a feed line 36, provided with a valve 38, which delivers water to the horizontal pipes 30, 32 and 34. Water from the feed line 36 passes down through a vertical first pipe 40 in the section 20 through a cut-off valve 42 and a union 44. The water than passes downwardly and upwardly through the several reversing bends and is gradually heated as it passes through the modular section 20.

From the last leg of the section the water passes through a union 46 and a connecting bend 48 to the next modular section 22. The modular section 22 is provided with cut-off valves 50 and 52 and a union 54. If the modular section 22 is to be by-passed, the valve 50 is closed and a cut-off valve 56 is opened for the water from the first section 20 to pass into a horizontal discharge line 57. If both the modular sections 20 and 22 are operating the water will pass through those sections and through a similar connecting arrangement between sections 22 and 24, namely a union 58, a cut-off valve 60, a connecting line 62, cut-off valves 64 and 66 and a union 68. At the end of the section 24 there is provided a union 70 and a cut-off valve 72. The valving system is such that any modular section may be isolated from the rest of the system and the system can remain operational. Since each modular section is connected to the other sections by unions, an entire section may be physically separated for servicing, repairs, replacement, etc. without interrupting the operation of the system.

The system may be operated so that water introduced at the inlet 36 will pass through the entire system, flowing through each section in succession until it passes through the discharge line 57, or the water may be divided into three separate flow paths, each path passing through its respective section once before discharge.

In the event that any section of the system requires servicing it may be isolated from the rest of the system for repair or replacement by merely closing the appropriate cut-off valves. An entire section may be removed by disconnecting the unions for the respective section.

Figure 2:
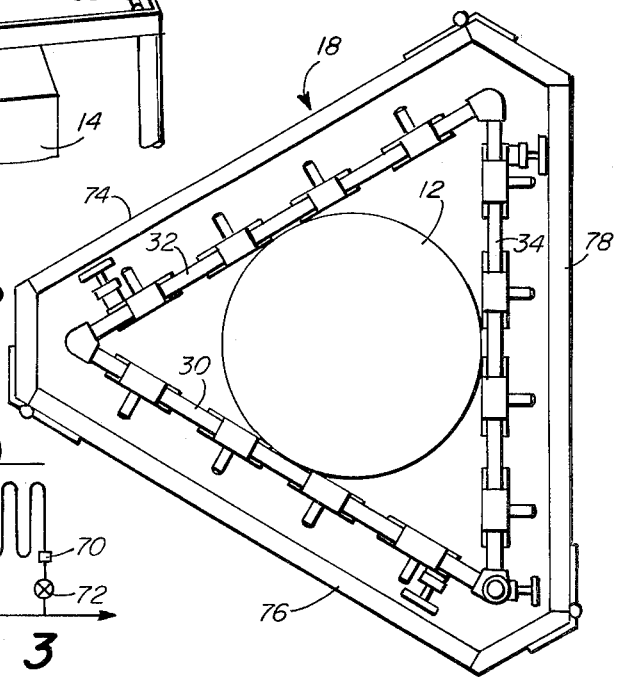
FIG. 2 is a top plan view thereof.
Figure 3:
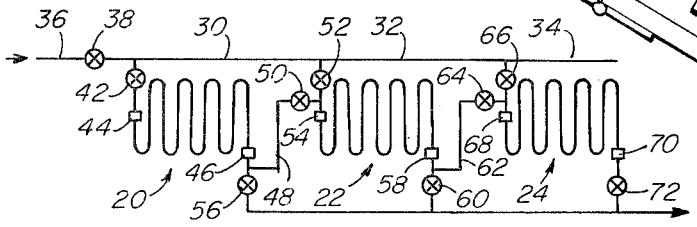
FIG. 3 is a schematic diagram of the system.

In order to maintain as much heat as possible in close proximity to the system for maximum heat transfer, the insulated housing 18 is provided to enclose both the system and the stack. As best shown in FIG. 2, the housing 18 is generally triangular in cross-section to conform with the triangular configuration of the system and to minimize dead air space. The housing 18 is provided with access doors 74, 76 and 78, one on each face thereof. The doors preferably are hinged to the housing or may be otherwise moveable to provide access to the system.

In order to prevent any water that might leak out of the system from dripping onto the furnace 14, a drip pan 80 is provided directly below the system and above the furnace. The drip pan 80, in the illustrated embodiment, is generally rectangular and formed with an upstanding lip 82 and a central opening through which the stack 12 extends. The pan is supported by tubular legs 84, one in each corner thereof, which support the pan so that the front end is slightly raised above the rear end thereof. The tubular legs 84 at the rear portion also serve as drain lines for the pan with the top of each rear leg 84 communicating with the pan through an opening 86 and 88 at the rear corners of the pan. The lower end of each of the rear legs is slotted at 90 so that dripping water collected in the pan will flow down through the rear legs onto the floor through the slot openings 90 thereby preventing direct contact with the furnace.

While the invention has been described with particular reference to the illustrated embodiment, numerous modifications thereto will appear to those skilled in the art. For example: instead of the triangular cross-sectional shape of the system the configuration may be polygonal or rectangular. Other modifications thereto will appear to those skilled in the art.

Having thus described the invention, what I claim and desire to obtain by Letters Patent of the United States is:

1. A system for recovering heat from the stack of a furnace or the like, comprising (a) a plurality of straight, rigid support pipes connected in end-to-end relation to define a closed geometric figure mountable horizontally about the exterior of said stack with each of said pipes extending in close relation to said stack, (b) a plurality of parallel pipe lengths forming a section depending from each support pipe, said pipe lengths being connected at alternating ends to define a plurality of coplanar reversing bends in each section of pipe lengths, (c) valve means connected to the first and last lengths of pipe in each section for selectively opening and closing a flow path through said section, (d) means connecting said system to a water supply source whereby water flowing through said system will be heated by the heat from said stack, and (e) an insulated housing substantially enclosing said system.

2. A system according to claim 1 wherein each section of pipe lengths is detachably connected to its associated support pipe and to the rest of said system whereby any one of said sections may be removed from said system.

3. A system according to claim 1 including a discharge pipe line connected to all of said sections.

4. A system according to claim 1 vent valves connected to each bend of each section.

5. A system according to claim 2 including a drip pan mounted below said sections to catch water dripping therefrom, a set of legs supporting said pan, at least one of said legs being tubular and formed at the lower end with at least one side opening and at the upper end communicating with the top of said pan to allow water collected by said pan to drain down said one leg.

* * * * *